US006846060B2

(12) United States Patent
Waller et al.

(10) Patent No.: US 6,846,060 B2
(45) Date of Patent: Jan. 25, 2005

(54) PRINTHEAD SERVICING MECHANISM AND METHOD

(75) Inventors: David J. Waller, Vancouver, WA (US); Jeffrey K. Pew, Lake Oswego, OR (US)

(73) Assignee: Hewlett-Packard Development Company, Houston, TX (US)

( * ) Notice: Subject to any disclaimer, the term of this patent is extended or adjusted under 35 U.S.C. 154(b) by 3 days.

(21) Appl. No.: 10/420,232

(22) Filed: Apr. 22, 2003

(65) Prior Publication Data

US 2004/0212654 A1 Oct. 28, 2004

(51) Int. Cl.[7] ..... B41J 2/165

(52) U.S. Cl. ..... 347/22; 347/29; 347/30; 347/32; 347/33

(58) Field of Search ..... 347/22–35

(56) References Cited

U.S. PATENT DOCUMENTS

| | | | | |
|---|---|---|---|---|
| 5,244,294 A | | 9/1993 | Ewing | |
| 5,831,644 A | * | 11/1998 | Kato | 347/22 |
| 6,309,044 B1 | | 10/2001 | Gaarder | |
| 6,702,424 B2 | * | 3/2004 | Takahashi | 347/33 |

* cited by examiner

*Primary Examiner*—Shih-Wen Hsieh

(57) ABSTRACT

A printhead servicing mechanism comprises a gear assembly actuated by a printhead carriage to move between an engaged position and a disengaged position, and a printhead servicing device actuated by the gear assembly in the engaged position.

19 Claims, 2 Drawing Sheets

PRINTHEAD SERVICING MECHANISM AND METHOD

BACKGROUND

Printing mechanisms may use one or more print cartridges, sometimes referred to as "pens," which may fire drops of liquid colorant, referred to generally herein as "ink," onto a page. Each print cartridge may have a printhead formed with very small nozzles through which the ink drops are fired. To print an image, the print cartridge carrying the printhead may be propelled back and forth across the page, firing drops of ink in a desired pattern as it moves. The particular ink ejection mechanism within the printhead may take on a variety of different forms known to those skilled in the art, such as those using piezo-electric or thermal printhead technology.

To clean and protect the printhead, a "service station" mechanism may be mounted within the printer housing. For storage, or during non-printing periods, the service station may include a capping system which hermetically seals the printhead nozzles from contaminants and drying. To facilitate priming, some printers have priming caps that are connected to a pumping unit to draw a vacuum on the printhead. During operation, partial occlusions or clogs in the printhead may be periodically cleared by firing a number of drops of ink through each of the nozzles in a clearing or purging process known as "spitting." The waste ink may be collected at a spitting reservoir portion of the service station, known as a "spittoon." Many service stations may have a flexible wiper, or a more rigid spring-loaded wiper, so that after spitting, uncapping, or occasionally during printing, the wiper may wipe the printhead surface to remove ink residue, as well as any paper dust or other debris that has collected on the printhead. After wiping of the printhead by the wiper, the wiper may be scraped by a scraper to remove ink residue from the wiper. The service station may be moved relative to the printhead to facilitate the capping, wiping and spitting functions discussed above.

Movement of the service station may be actuated by a dedicated transmission assembly. Such a dedicated transmission assembly may require space within the housing of the printing assembly which may increase the overall size of the printing assembly. Use of a dedicated transmission assembly may also increase the overall cost and power requirements of the printing assembly. Therefore, for these and other reasons there is a need for the present invention.

SUMMARY

One embodiment of a printhead servicing mechanism comprises a gear assembly actuated by a printhead carriage to move between an engaged position and a disengaged position, and a printhead servicing device actuated by the gear assembly in the engaged position.

DETAILED DESCRIPTION OF THE DRAWINGS

Figure 1:
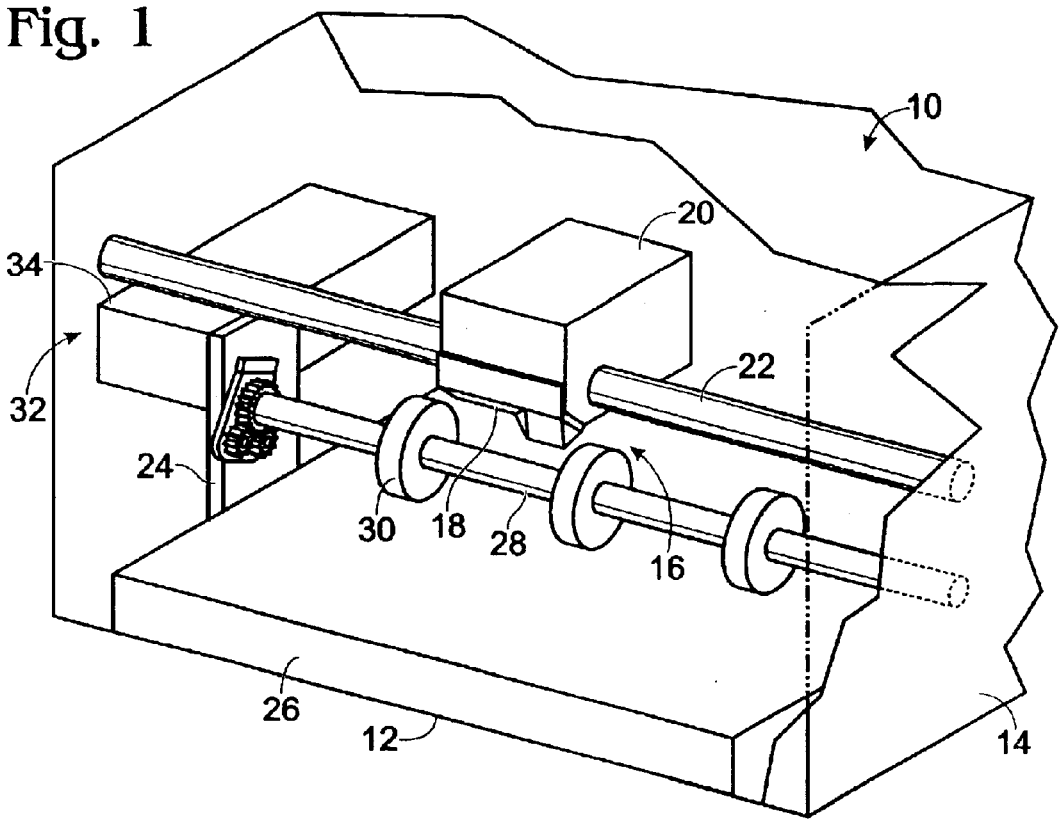
FIG. 1 is a front perspective view of one form of a printing mechanism including one embodiment of the printhead servicing mechanism of the present invention wherein the printhead is positioned in a printzone.

FIG. 1 illustrates one embodiment of a printing mechanism constructed in accordance with one embodiment of the present invention. The printing mechanism may be used for the printing of business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience, the concepts of the present invention are illustrated in the environment of a printer 10. However, other printing mechanisms, such as laser printers and the like, may include an embodiment of the printhead servicing mechanism of the present invention.

While the printer's components may vary, printer 10 may include a base 12 surrounded by a housing or casing enclosure 14. Base 12 may be manufactured of steel or the like whereas housing 14 may be manufactured of a plastic material. Sheets of print media may be fed through a printzone 16 to a printhead 18 which may be supported by a printhead carriage 20. Printhead carriage 20 may be movably mounted on a carriage rod 22 for movement there along, wherein carriage rod 22 may be mounted on a chassis 24 which may be secured to base 12. In this figure, printhead carriage 20 is shown positioned in printzone 16. The print media may be any type of suitable material, such as paper, card-stock, transparencies, mylar, and the like, but for convenience, the illustrated embodiment is described using a sheet of paper as the print medium. The printer 10 may include a feed tray 26 for storing sheets of print media before printing thereon. One or more motor-driven drive shafts 28, which may have one or more drive rollers 30 mounted thereon, may be used to move the print media from tray 26 into printzone 16 for printing. During operation of printer 10, printhead 18 may be moved into a servicing region 32 which may include a printhead servicing mechanism, such as a servicing sled 34.

Figure 2:
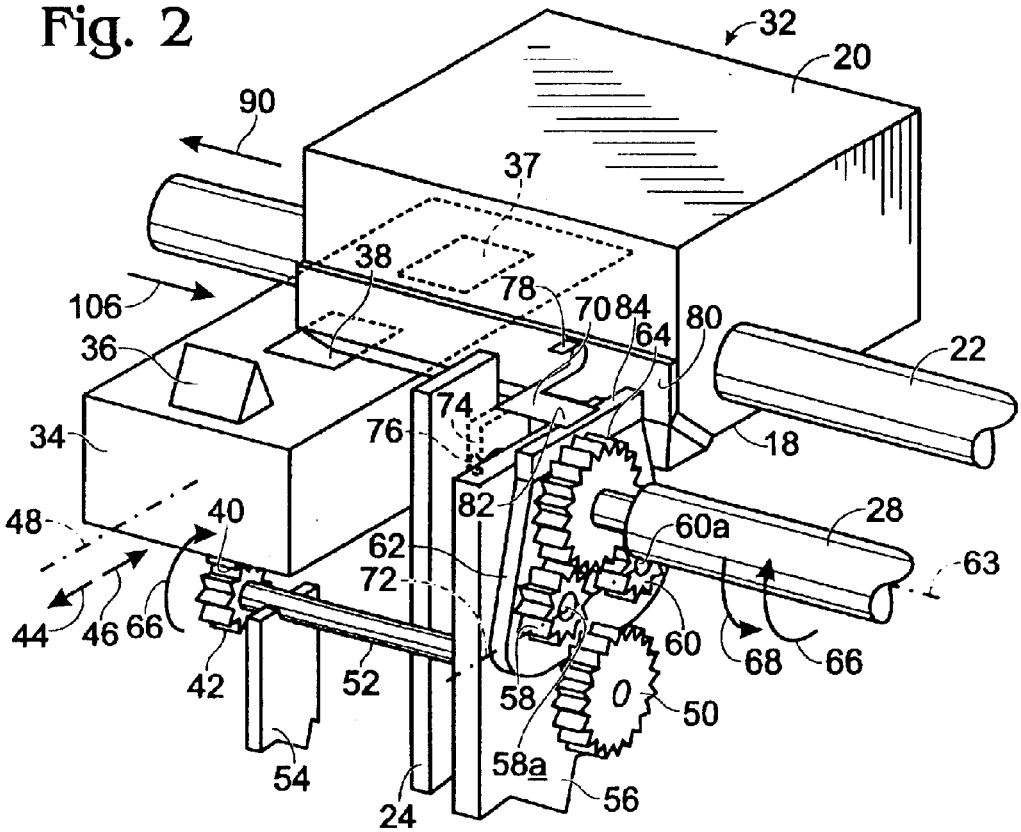
FIG. 2 is a detailed perspective view of one embodiment of the printhead servicing mechanism of FIG. 1 wherein the printhead is positioned in a servicing region.

FIG. 2 is a detailed perspective view of one embodiment of the printhead servicing region 32 of the present invention wherein printhead carriage 20 is shown positioned in servicing region 32. In this embodiment, sled 34 may include one or more wipers 36, a cap 37 (shown in dash lines) and a spittoon 38 for servicing printhead 18. Sled 34 may further include a gear system 40, such as a rack (partially shown) positioned on an underside of sled 34, operatively connected to a gear 42, wherein actuation of gear 42 may actuate movement of sled 34 in either of directions 44 and 46 along sled axis of movement 48.

Gear 42 may be fixedly connected to a sled actuation gear 50 by a rod 52 such that rotation of gear 50 may cause corresponding rotation of gear 42. Rod 52 may be supported by two support walls 54 and 56, respectively, of base 12 (see FIG. 1). Gear 50 may be positioned adjacent two toggle gears 58 and 60, wherein each of gears 58 and 60 may be connected to a toggle base 62. Each of gears 58 and 60 may be rotatably connected to toggle base 62 such that the gears 58 and 60 may rotate about their central axis 58*a* and 60*a*, respectively, on toggle base 62. Toggle base 62 may be pivotally mounted on drive shaft 28 such that toggle base 62 may pivot about a central axis 63 of drive shaft 28. Toggle gears 58 and 60 may both mate with a gear 64 on drive shaft 28 such that rotation of drive shaft 28 in direction 66 may rotate gear 64 in direction 66, which in turn may rotate each of toggle gears 58 and 60 in direction 68 about their central axis 58*a* and 60*a*, respectively. Conversely, rotation of shaft 28 in direction 68 may rotate gear 64 in direction 68, which in turn may rotate each of gears 58 and 60 in direction 66 about their central axis 58*a* and 60*a*, respectively.

In the position shown in FIG. 2, toggle base 62 is retained in a non-actuated position by an actuation device 70, such as a biasing element, namely, a leaf spring 70, such that central axes 58*a* and 60*a* of toggle gears 58 and 60, respectively, may be aligned in their non-actuated position along a horizontal axis 72. In this non-actuated position, neither of toggle gears 58 or 60 may contact sled actuation gear 50 such that gear 50, and therefore gear 42, may not rotate upon rotation of gears 58 and 60. Accordingly, in this non-actuated position sled 34 may not be actuated for movement along sled axis 48.

Leaf spring 70 may comprise a base section 74 secured to chassis 24 by a fastener 76 and a printhead carriage contact section 78 that may contact a complex contacting surface 80 of printhead carriage 20. Complex contacting surface 80 may define a contact region including multiple contact surfaces that may each have a different angle or inclination from the other contact surfaces. Printhead carriage contact section 78 of leaf spring 70 may include a curved upper section such that a generally rounded surface of the leaf spring may contact complex contacting surface 80 of printhead carriage 20. Leaf spring 70 may further comprise a toggle gear contacting section 82 that in the non-actuated position may contact a top surface 84 of toggle base 62. In an actuated position, as will be discussed in more detail below, toggle gear contacting section 82 of leaf spring 70 may be removed from contact with top surface 84 of toggle base 62 such that toggle base 62 may pivot about shaft 28 in either of directions 66 or 68 such that one of toggle gears 58 or 60 may contact sled actuation gear 50.

Figure 3:
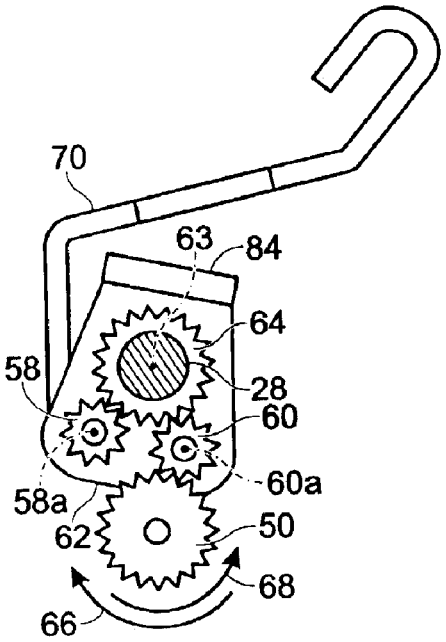
FIGS. 3 and 4 are side views showing pivotal movement of one embodiment of a toggle base of the present invention.

FIG. 3 shows a side view of toggle base 62 wherein shaft 28 may be rotating in direction 66 and wherein toggle gear contacting section 82 of leaf spring 70 may be removed from contact with toggle base 62. In this actuated position of toggle base 62, toggle base 62 may be pivoted about axis 63 of shaft 28 in direction 66 such that toggle gear 60 may contact and engage sled actuation gear 50, which may thereby actuate gear 42 (see FIG. 2) and sled 34 (see FIG. 2).

Figure 4:
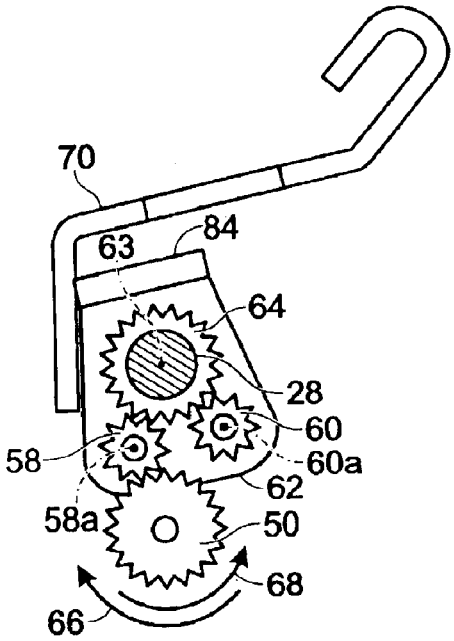

FIG. 4 shows a side view of toggle base 62 wherein shaft 28 may be rotating in direction 68 and wherein toggle gear contacting section 82 of leaf spring 70 may be removed from contact with toggle base 62. In this actuated position of toggle base 62, toggle base 62 may be pivoted about axis 63 of shaft 28 in direction 68 such that toggle gear 58 may contact and engage sled actuation gear 50, which may thereby actuate gear 42 (see FIG. 2) and sled 34 (see FIG. 2).

Figure 5:
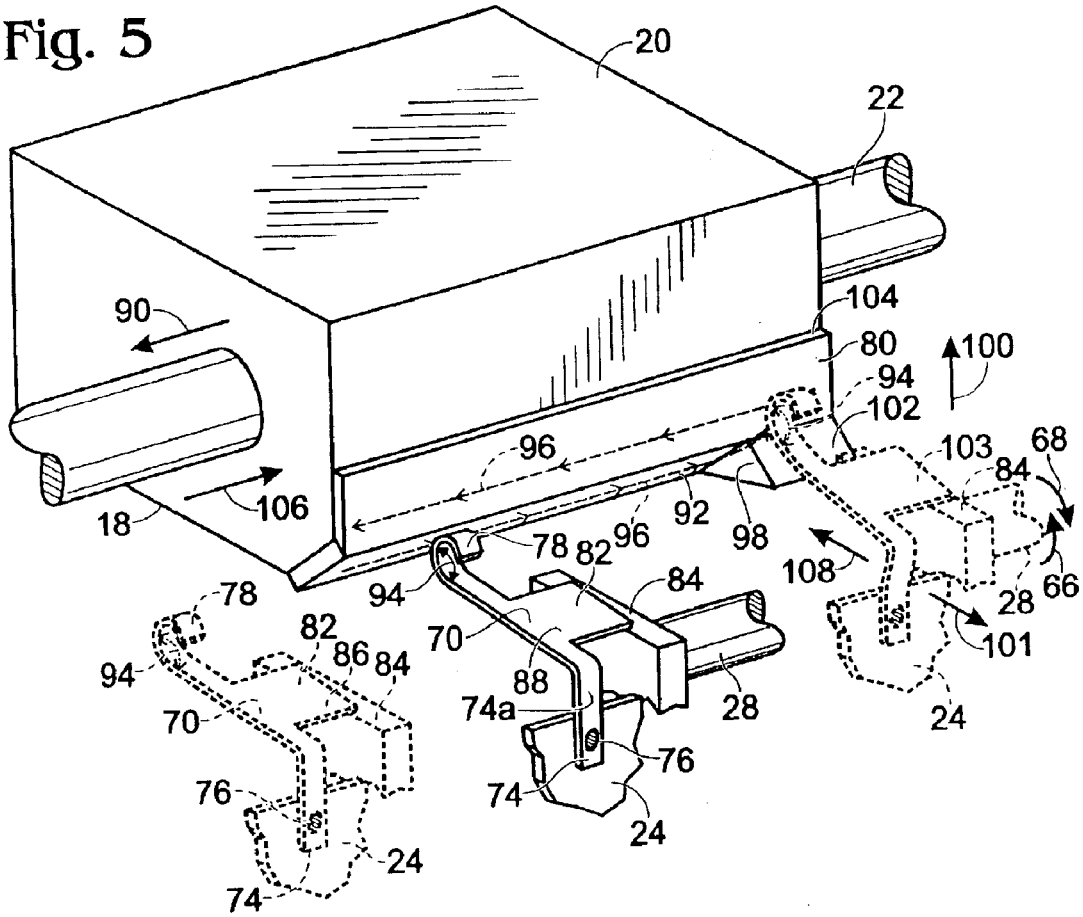
FIG. 5 is a detailed perspective view of one embodiment of a leaf spring of the servicing mechanism in several different conditions.

FIG. 5 is a detailed perspective view of leaf spring 70 in several different conditions. Prior to contact with printhead carriage 20, leaf spring 70 may be in the nominal, unbiased condition shown as reference number 86 (leaf spring 70 shown in dash lines). In this position, an angle 94 of printhead contact section 78 may be approximately one hundred and twenty degrees. As printhead carriage 20 moves in direction 90 along rod 22 into servicing region 32, printhead contact section 78 of leaf spring 70 may contact a first section 92 of printhead contacting surface 80. This condition of leaf spring 70 is shown as reference number 88 (leaf spring 70 shown in solid lines). First section 92 may define a generally downwardly inclined surface that may tend to bend printhead contact section 78 of leaf spring 70 so as to decrease angle 94 between contact section 78 and toggle gear section 82 of leaf spring 70. In this condition angle 94 may be approximately one hundred and ten degrees. As printhead carriage 20 continues to move in direction 90, base section 74 of leaf spring 70, which may be fixedly secured by fastener 76 to chassis 24, may remain stationary. Accordingly, printhead contact section 78 may move along a path 96 (indicated in dash lines) along first section 92 of contacting surface 80 of printhead carriage 20. During contact of contact section 78 with first section 92 of surface 80, toggle gear section 82 of leaf spring 70 may remain in the non-actuated position, i.e., may remain in contact with top surface 84 of toggle base 62. Contact of leaf spring 70 with toggle base 62 may retain toggle base 62 in the non-actuated position such that toggle base 62 may be restrained by leaf spring 70 from pivoting about shaft 28 (see FIG. 2) so that gear 50 (see FIG. 2) is not actuated.

As printhead carriage 20 moves further in direction 90, printhead contact section 78 of leaf spring 70 may continue to follow path 96 such that printhead contact section 78 of leaf spring 70 may contact a second section 98 of contacting surface 80 of printhead carriage 20. Second section 98 of printhead contacting surface 80 may define a generally upwardly inclined surface that may tend to allow angle 94 of leaf spring 70 to increase, i.e., the upwardly inclined surface may tend to allow leaf spring 70 to somewhat flatten out in printhead contact section 78, such that contact section 78 of leaf spring 70 may tend to move upwardly in direction 100 on second section 98 of printhead carriage 20. Additionally, an upper region 74*a* of base section 74 of leaf spring 70 may tend to move in an outward direction 101 away from chassis 24. Upward movement of contact section 78 of leaf spring 70 may tend to move toggle gear section 82 of leaf spring 70 upwardly in direction 100 so that toggle gear section 82 of the leaf spring 70 may move out of contact with top surface 84 of toggle base 62 (see FIG. 2).

As printhead carriage 20 moves further in direction 90, printhead contact section 78 of leaf spring 70 may continue to follow path 96 such that printhead contact section 78 of leaf spring 70 may contact a third section 102 of contacting surface 80 of printhead carriage 20. Third section 102 of printhead contacting surface 80 may define an upwardly inclined surface that may have a more steep upward inclination than that of second section 98 of printhead carriage 20. Accordingly, third section 102 may tend to further allow angle 94 of leaf spring 70 to increase, i.e., the upwardly inclined surface 102 may tend to allow leaf spring 70 to further flatten out in printhead contact section 78, such that contact section 78 of leaf spring 70 may tend to move further upwardly in direction 100 on third section 102 of printhead carriage 20 and into a fourth section 104 of printhead carriage 20, this condition of leaf spring 70 being shown as reference numeral 103 (leaf spring 70 shown in dash lines). In this condition, angle 94 of printhead contact section 78 of leaf spring 70 may be approximately one hundred and twenty degrees. Such relative flattening out of printhead contact section 78 of leaf spring 70 at fourth section 104 may be quite quick along this portion of path 96 such that leaf spring 70 may appear to "pop" upwardly into a somewhat flat, nominal position of contact section 78 of leaf spring 70. This upward movement of contact section 78 of leaf spring 70 onto fourth section 104 may tend to move upper region 74a of base section 74 of leaf spring 70 further outwardly in direction 101 away from chassis 24, and may also tend to move toggle gear section 82 of leaf spring 70 further upwardly in direction 100 a distance from top surface 84 of toggle base 62 (see FIG. 2) that is sufficient to allow toggle base 62 to pivot about shaft 28 (see FIG. 2).

Referring now to FIGS. 2–5, in this upward position of toggle gear section 82 of leaf spring 70, wherein leaf spring 70 is indicated by reference number 103, and wherein leaf spring 70 contacts fourth section 104 of printhead carriage 20, toggle base 62 may be allowed to pivot about shaft 28, which may define the actuated position of toggle base 62. In this actuated position 103, toggle base 62 may rotate about shaft 28 in either of directions 66 or 68 such that either of toggle gears 58 or 60 may contact sled actuation gear 50. In particular, toggle base 62 may be in frictional contact with gear 64 such that rotation of shaft 28 in direction 66 may rotate gear 64 in direction 66, which in turn may tend to rotate toggle base 62 in direction 66. Rotation of gear 64 in direction 66, by direction contact with gear 60, may rotate toggle gear 60 about its central axis 60*a* in direction 68. Rotation of toggle base 62, including gears 58 and 60 mounted thereon, in direction 66 may occur until gear 60 contacts sled actuation gear 50 (see FIG. 3). Upon contact of toggle gear 60 with sled actuation gear 50, the gears 50 and 60 may mesh with one another such that as gear 60 may be rotated in direction 68 by rotation of gear 64 in direction 66, gear 60 may tend to rotate sled actuation gear 50 in direction 66. Rotation of gear 50 in direction 66 may rotate gear 42 in direction 66 thereby moving sled 34 in direction 46. Conversely, rotation of shaft 28 in direction 68 may tend to rotate gear 64 in direction 68 which may in turn rotate toggle base 62 in direction 68. Rotation of toggle base 62 in direction 68 may tend to mesh gears 58 and 50 such that gear 50 may be rotated in direction 68 (see FIG. 4). Rotation of gear 50 in direction 68 may tend to rotate gear 42 in direction 68 thereby moving sled 34 in direction 44. Accordingly, if printhead carriage 20 is not moved while leaf spring 70 is in contact with fourth section 104 of printhead carriage contacting surface 80, sled 34 may remain in the actuated or engaged condition such that rotation of shaft 28 may continue to engage sled 34 for movement in either of directions 44 or 46 (see FIG. 2).

The provision of two toggle gears 58 and 60 on toggle base 62 may allow the actuated toggle gear, 58 or 60, to be "driven into engagement" with sled actuation gear 50, i.e., may allow the actuated toggle gear 58 or 60 to tightly mesh with sled actuation gear 50 without the gears skipping or becoming unmeshed during rotation thereof. In particular, rotation of shaft 28 in direction 66 may drive gear 60 into engagement with gear 50 whereas rotation of shaft 28 in direction 68 may drive gear 58 into engagement with gear 50. Accordingly, rotation of shaft 28 in either of directions 66 or 68 may result in a toggle gear being driven into engagement with gear 50. This two toggle gear system, therefore, may decrease the likelihood that the toggle gear 58 or 60 may skip of jump out of mating contact with gear 50 during rotation of the toggle gear 58 or 60.

Engagement, i.e., actuation, of sled 34 may allow the sled to perform wiping, capping and spitting operations so as to service printhead 18 while the printhead remains in servicing region 32. Once printhead 18 has been wiped, scraping of wiper 36 may be desired. Scraping of wiper 36 by a scraper (not shown) may tend to flick scraped ink onto printhead 18 or onto printhead carriage 20 if the printhead carriage 20 remains positioned adjacent sled 34. Accordingly, it may be desirable to move printhead carriage 20 at least partially outwardly of servicing region 32 in direction 106 so as to protect the printhead carriage 20 from flicked ink, while retaining sled 34 in the actuated configuration. The tendency of leaf spring 70 to remain relatively straight, or somewhat flattened out, in section 78 may allow the printer 10 of the present invention to accomplish this task.

Referring again to FIG. 5, as printhead carriage 20 changes direction and moves in direction 106, printhead contact section 78 of leaf spring 70 may continue to follow path 96 such that printhead contact section 78 of leaf spring 70 may remain in contact with fourth section 104 of contacting surface 80 of printhead carriage 20, such that leaf spring 70 remains disengaged from toggle base 62 and such that toggle base 62 may remain in the actuated position. The tendency of section 78 of leaf spring 70 to remain in the relatively flat condition in section 78 may prevent or hinder section 78 of leaf spring 70 from moving downwardly into first section 92 of printhead carriage contact surface 80, wherein the leaf spring 70 may contact toggle base 62 in such a downward position. Accordingly, movement of printhead carriage 20 back and forth in either of directions 90 or 106 may retain leaf spring 70 in contact with fourth section 104 of printhead carriage 20 such that toggle base 62 may remain in the actuated position and sled 34 may remain in the engaged position. Once printhead carriage 20 is moved in direction 106 a sufficient distance, such that leaf spring 70 is no longer in contact with fourth section 104 of printhead carriage 20, the leaf spring may be allowed to move to its nominal position shown by reference number 86, wherein the upper region 74*a* of base section 74 of leaf spring 70 moves in direction 108 and back into its initial position against chassis 24. In this initial, unbiased position, toggle gear section 82 of leaf spring 70 is positioned on top surface 84 of toggle base 62. In this non-actuated position, leaf spring 70 may force toggle base 62 to align itself with gears 58 and 60 positioned along horizontal axis 72 (see FIG. 2) such that sled actuation gear 50 is not engaged.

Accordingly, there is described a servicing sled 34 that may be powered by drive shaft 28 but that may be actuated, i.e., may be switched between powered and non-powered conditions, by movement of printhead carriage 20. Moreover, printhead carriage 20 may be moved outwardly or somewhat outwardly from servicing region 32 while still retaining sled 34 in the actuated position by contact of leaf spring 70 with fourth section 104 of contact surface 80 of printhead carriage 20.

Other enhancements may be made to the servicing mechanism wherein such variations and modifications of the concepts described herein fall within the scope of the claims below.

We claim:

1. A printhead servicing mechanism, comprising:

a gear assembly actuated by a printhead carriage to move between an engaged position and a disengaged position; and a printhead servicing device actuated by said gear assembly in the engaged position, wherein said printhead carriage includes separate first and second contact surfaces, and wherein said gear assembly is actuated by sequential contact with said separate first and second contact surfaces of said printhead carriage.

2. A printhead servicing mechanism according to claim 1 wherein said gear assembly includes a biasing member, wherein said biasing member is actuated by said printhead carriage to move said gear assembly between said engaged and disengaged positions.

3. A printhead servicing mechanism according to claim 2 wherein said biasing member comprises a leaf spring.

4. A printhead servicing mechanism according to claim 1 wherein said printhead servicing device comprises a servicing sled including a wiper, a cap and a spittoon.

5. A printhead servicing mechanism according to claim 1 wherein said printhead carriage is adapted for movement while maintaining said gear assembly in contact with at least one of said separate first and second contact surfaces.

6. A printhead servicing mechanism according to claim 1 wherein said printhead servicing device comprises a servicing sled actuated by a sled actuation gear, said gear assembly comprises a base having at least two gears rotatably mounted thereon, said base being pivotally mounted on a drive shaft wherein rotation of said drive shaft pivots at least one of said two gears into rotating engagement with said sled actuation gear.

7. A printer including a print head and a sled for servicing said printhead, said printer comprising:

a base adapted for pivotal movement in first and second opposing pivot directions, said base including first and second gears rotatably mounted thereon, wherein pivotal movement of said base in said first pivot direction moves said first gear into mating engagement with a sled actuation gear and wherein pivotal movement of said base in said second pivot direction moves said second sear into mating engagement with the sled actuation gear.

8. A printer according to claim 7 further comprising an actuation device that moves between an actuated position and a non-actuated position, wherein said actuation device in said non-actuated position prevents pivotal movement of said base such that said sled actuation gear is not engaged.

9. A printer according to claim 8 wherein said actuation device comprises a biasing element and wherein said biasing element contacts said base in the non-actuated position and wherein said biasing element is out of contact with said base in the actuated position.

10. A printer according to claim 9 wherein said biasing element is moved out of contact with said base by contact with a printhead carriage of said printer.

11. A printing mechanism comprising:

a drive shaft adapted for rotation about a drive shaft axis in first and second opposing rotational directions;

a base pivotally mounted on said drive shaft and adapted for pivotal movement on said drive shaft in first and second opposing pivotal directions corresponding to said first and second opposing rotational directions; and a printhead servicing sled actuation device in contact with said base when said base pivots in either of said first or second opposing pivotal directions, and wherein said sled actuation device is out of contact with said base when said base is restrained from pivotal movement on said drive shaft.

12. A printing mechanism according to claim 11 wherein said drive shaft includes a drive shaft gear aligned along said drive shaft axis, and said base includes first and second gears positioned in mating contact with said drive shaft gear, wherein said sled actuation device is positioned in contact with said first gear when said base pivots in said first pivotal direction, and wherein said sled actuation device is positioned in contact with said second gear when said base pivots in said second pivotal direction.

13. A printing mechanism according to claim 11 further comprising a printhead carriage and an actuation device, wherein said actuation device is moved from a non-actuated position to an actuated position by contact with said printhead carriage.

14. A printing mechanism according to claim 13 wherein said actuation device comprises a leaf spring including a base section and a printhead carriage contact section, wherein said base section is secured to a chassis of said printing mechanism and said printhead carriage contact section comprises an angled section and a curved upper section.

15. A printer comprising:

a drive shaft having a drive shaft gear mounted thereon, said drive shaft adapted for rotation about a drive shaft axis of rotation wherein rotation of said drive shaft rotates said drive shaft gear;

a base pivotally mounted on said drive shaft, said base including first and second gears rotatably mounted on said base and engaged with said drive shaft gear so said first and second gears are rotated by rotation of said drive shaft gear;

a sled actuation gear engaging one of said first and second gears when said base pivots about said drive shaft;

a servicing sled actuated by said sled actuation gear;

a printhead carriage that moves from a printzone into a servicing region; and an actuation device that moves from a non-actuated position to an actuated position by contact with said printhead carriage as said printhead carriage moves into said servicing region, wherein said actuation device in the non-actuated position restrains said base from pivotal movement and wherein said actuation device in the actuated position allows said base to pivot about said drive shaft.

16. A method of actuating a servicing mechanism to service a printhead, comprising:

moving a printhead carriage into contact with an actuation device so as to move the actuation device from a non-actuated condition to an actuated condition; and rotating a drive shaft having a base mounted thereon, wherein rotation of said drive shaft rotates said base when said actuation device is in the actuated condition, and wherein rotation of said base actuates a servicing mechanism to service said printhead.

17. A method according to claim 16 further comprising:

further moving said printhead carriage while retaining contact with said actuation device so as to retain said actuation device in the actuated condition.

18. A method according to claim 16 further comprising:

moving said printhead carriage out of contact with said actuation device so as to move the actuation device from the actuated condition to the non-actuated condition, wherein rotation of said drive shaft does not rotate said base when said actuation device is in the non-actuated condition.

19. A printhead servicing mechanism, comprising:

means for moving between an engaged position and a disengaged position;

means for printing configured to selectively actuate the means for moving by advancing into and out of contact with the means for moving wherein said means for printing includes separate first and second contact surfaces, and wherein said means for moving is actuated by sequential contact with said separate first and second contact surfaces of said means for printing; and means for servicing said means for printing, said means for servicing actuated by said means for moving in the engaged position.

* * * * *